United States Patent [19]

Gholson

[11] 4,296,823

[45] Oct. 27, 1981

[54] CABLE TOOL WITH CIRCULATING DRILL STEM

[75] Inventor: Wayne Gholson, Scottsville, Ky.

[73] Assignee: Varel Manufacturing Company, Dallas, Tex.

[21] Appl. No.: 83,988

[22] Filed: Oct. 11, 1979

[51] Int. Cl.[3] ..... E21B 7/00; E21B 10/36; E21B 27/00

[52] U.S. Cl. ..... 175/308; 175/234; 175/242; 175/418

[58] Field of Search ..... 175/232, 234, 236, 242, 175/254, 320, 308, 418; 166/162, 165, 167, 169, 107

[56] References Cited

U.S. PATENT DOCUMENTS

| | | | |
|---|---|---|---|
| 212,218 | 2/1879 | Manning | 175/234 |
| 947,862 | 2/1910 | Steel | 175/232 |
| 1,167,225 | 1/1916 | Smith | 175/232 |
| 1,300,346 | 4/1919 | Church . | |
| 1,399,108 | 12/1921 | Garrison . | |
| 1,513,083 | 10/1924 | Baker | 175/234 |
| 1,940,866 | 12/1933 | Humason . | |
| 2,019,978 | 11/1935 | Hunt . | |
| 2,148,373 | 2/1939 | Garfield . | |
| 2,171,539 | 9/1939 | Burns . | |
| 2,214,970 | 9/1940 | Mooney | 175/242 |
| 2,330,157 | 9/1943 | Stokes . | |
| 2,646,128 | 7/1953 | Reyholds | 175/242 X |
| 2,721,059 | 10/1955 | Wilcox | 175/242 X |
| 2,787,327 | 4/1957 | Pearson . | |

*Primary Examiner*—Stephen J. Novosad
*Attorney, Agent, or Firm*—Richards, Harris & Medlock

[57] ABSTRACT

A cable tool (10) includes a tool bit (12), a drill stem (14) and an adapter (16). Openings (32) are formed in a cutting face (18) of the tool bit (12) and inclined bores (34) extend upwardly within the tool bit (12) to an upwardly extending bit passageway (36). A retention chamber (46) is formed in the drill stem (14) communicating with the bit passageway (36) for storing rock and earth particles. An adapter passageway (52) communicates with the retention chamber (46) and includes a liquid drain (24) to drain water from the adapter passageway (52) and the retention chamber (46). Optionally, a flapper valve (64) may be mounted within the retention chamber (46) adjacent the bit passageway (36).

18 Claims, 3 Drawing Figures

CABLE TOOL WITH CIRCULATING DRILL STEM

TECHNICAL FIELD

The present invention relates to well boring devices, and particularly relates to cable tools for drilling wells by a dropping action.

BACKGROUND ART

Cable tools are used to drill wells by a dropping action. The cable tool is attached to a cable, lowered into a well hole and repetitively raised and dropped. A cutting face on the lower end of the cable tool cuts, chisels and crushes rock and earth during the repetitive dropping action. Often, the bottom of the well hole is filled with water, so that the cable tool operates in a water environment.

With continued cable tool drilling, the well hole bottom accumulates rock and earth particles that have been cut and crushed by the cable tool. This accumulation of rock and earth particles impairs the drilling ability of the cable tool. Eventually, the cable tool must be removed from the well hole and a cleanout tool is lowered into the well hole to remove the accumulated debris. Cable tools have been designed to simultaneously pump debris from the bottom of the well hole as the cable tool cuts in the dropping action, such as disclosed in a patent to L. Garrison, U.S. Pat. No. 1,399,108, wherein the lifting cable is operable to activate a pump within the cable tool as well as to repetitively lift and drop the cable tool. Such conventional cable tool designs have been found to be generally expensive and impractical from an engineering and economic standpoint.

A long-felt need persists for an improved, relatively inexpensive, cable tool capable of removing debris from the bottom of a well hole during drilling operations. By removing such debris, the improved cable tool may continue to drill for an extended drilling period relative to conventional cable tools before the improved cable tool must be removed for cleanout of the well hole. Moreover, removal of debris from the bottom of the hole improves the efficiency of the cable tool bit, significantly increasing the rate of penetration.

DISCLOSURE OF THE INVENTION

The present invention provides a cable tool capable of removing debris from the bottom of a well hole and storing such debris within the cable tool during drilling operations. In this manner, the length of a drilling period between cleanout operations, using the cable tool of the present invention, is extended relative to conventional cable tools. Furthermore, the cable tool of the present invention is comparable in cost of manufacturing to conventional cable tools.

In accordance with the present invention, a cable tool for crushing and cutting rock and earth particles by a dropping action to form a well hole includes a tool bit with a cutting face for dropping against rock and earth. An upper tool body is connected to the tool bit and includes an upper body end for connection to a cable extending down the well hole. At least one opening is formed in the cutting face of the tool bit for receiving and removing rock and earth particles from the bottom of the well hole to facilitate the crushing and cutting of the rock and earth. A passageway is formed in the cable tool bit extending from the opening to the upper tool body for transmitting rock and earth particles upwardly away from the cutting face and the bottom of the well hole. A retention chamber is formed in the upper tool body for receiving rock and earth particles from the passageway to contain and store the rock and earth particles for subsequent removal when the cable tool is removed from the well hole.

A pressure relief drain is formed in the upper tool body to allow liquids to escape or drain from the retention chamber. In this manner, water or other liquids may circulate through the cable tool by entering the opening and passing through the passageway and the retention chamber, and escaping through the pressure relief drain. Thus, water in the bottom of the well hole will not fill the retention chamber to interfere with the storage or rock and earth particles therein nor is there pressure in the chamber which would prevent these particles from entering the chamber.

A valve means is optionally provided adjacent the passageway in the cable tool bit to block the transmission of rock and earth particles from the retention chamber to the passageway and to transmit or permit the transmission of rock and earth particles from the passageway to the retention chamber.

In accordance with a particular embodiment of the present invention, a cable tool for crushing and cutting rock and earth by a dropping action to form a well hole includes a tool bit with a cutting face for dropping against rock and earth. A drill stem is attached to the upper end of the tool bit, and an adapter is attached to the upper end of the drill stem for attachment to a cable extending down the well hole. An opening in the cutting face of the tool bit includes two bores extending through the cutting face and intersecting within the tool bit. Both bores communicate with a bit passageway formed in the tool bit extending from the opening to the drill stem for transmitting rock and earth particles upwardly and away from the cutting face and the bottom of the well hole. A retention chamber is formed in the drill stem for receiving rock and earth particles from the bit passageway to contain and store the rock and earth particles for subsequent removal when the cable tool is removed from the well hole.

An adapter passageway is formed in the adapter extending from the retention chamber and terminating within the adapter. A pressure relief drain is also formed in the adapter communicating between the adapter passageway and the exterior of the adapter for relieving pressure, transmitting and draining water and liquids from the adapter passageway and the retention chamber to the exterior of the adapter.

The pressure relief drain includes a recess in the exterior of the adapter and a drain bore extending through the adapter from the recess to the adapter passageway. A door flap is pivotally mounted on the adapter within the recess and above the drain bore to selectively cover the drain bore. The door flap will block foreign objects from entering the drain bore from the exterior of the adapter, but will transmit liquid, such as water, from the drain bore to the exterior of the adapter.

A flapper valve is mounted in the retention chamber adjacent the passageway and includes a flapper pivotally moveable between a horizontal position and a generally upright position. In the horizontal position, the flapper will prevent or block the transmission of rock and earth particles from the retention chamber to the bit passageway in the cable tool. When the flapper is in the generally upright position, rock and earth particles may be transmitted from the passageway into the retention chamber. The flapper moves in response to the movement of rock and earth particles and liquids within the bit passageway and the retention chamber. An alternate arrangement to a flapper valve would be a ball and seat valve that would open on the downstroke and close on the upstroke. Thus, it will be understood that many conventional valves may be used as the pressure relief valve of the present invention.

BRIEF DESCRIPTION OF THE DRAWINGS

The invention may best be understood by reference to the following Detailed Description of the preferred embodiment as illustrated in the accompanying Drawings in which.

DETAILED DESCRIPTION OF THE PREFERRED EMBODIMENT

Figure 1:
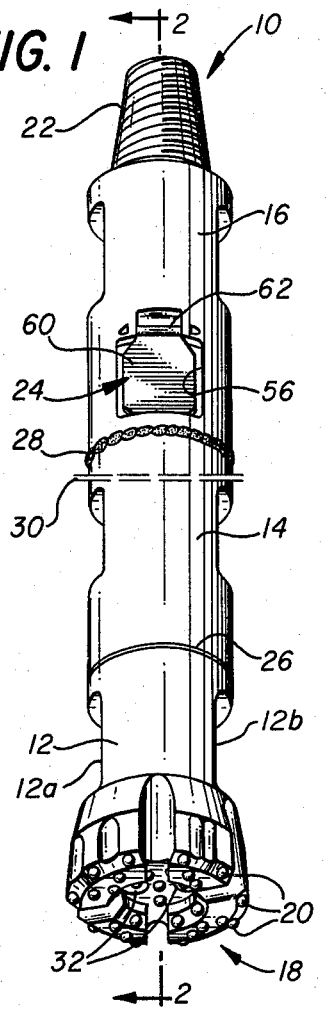
FIG. 1 is a perspective view of a cable tool embodying the present invention.

Referring now to the Drawings in which like reference characters designate like or corresponding parts throughout the several views, there is shown in FIG. 1 a cable tool 10 embodying the present invention. The main components of the cable tool 10 are a tool bit 12 attached at the lower end of the cable tool 10, a drill stem 14 forming the mid-section of the cable tool 10, and an adapter 16 connected to the upper end of the drill stem 14 for attaching the cable tool 10 to a cable extending down a well hole.

A cutting face 18 is formed on the lowermost end of the tool bit 12 and includes projections 20 for cutting, chiseling and crushing rock and earth. A threaded pin 22 is formed on the uppermost end of the adapter 16 for attachment to a cable for extension down a well hole. In a drilling operation, the cable repetitively lifts and drops the cable tool 10 within a well hole to repetitively impact the cutting face 18 against the bottom of the well hole. Rock and earth particles are cut and crushed by the cutting face 18 and are transmitted through the tool bit 12 and into the drill stem 14. Also, water or liquid may be transmitted through the tool bit 12, through the drill stem 14, through the adapter 16 and out of a pressure relief drain 24 formed in the adapter 16. The transmission and storage of rock and earth particles within the cable tool 10 and the circulation of water or liquids within the cable tool 10 will be hereinafter described in greater detail.

The cable tool 10 is constructed of steel suitable for the construction of cable tools chosen in accordance with conventional cable tool design considerations. In the preferred embodiment of the present invention, the cutting face 18 on the tool bit 12 has a maximum diameter of about 16.4 cm., and the drill stem 14 has a maximum outside diameter of about 12.7 cm. The length of the drill stem 14 from a junction 26 between the tool bit 12 and the drill stem 14 to a junction weld 28 between the drill stem 14 and the adapter 16 is about 6.1 meters. It will be noted that a portion of the drill stem 14 has been removed as indicated by break lines 30 so that the length of drill stem 14 shown in FIG. 1 is disproportionately small in comparison to the remaining dimensions of cable tool 10 shown in FIG. 1. It will be understood that cable tool 10 may be of any appropriate dimension for a cable tool. Also it will be appreciated that FIG. 1 is somewhat diagrammatical for illustraing the basic concepts of the present invention and that the configuration shown in FIG. 1 may be subjected to substantial modification without departing from the spirit of the present invention.

Figure 2:
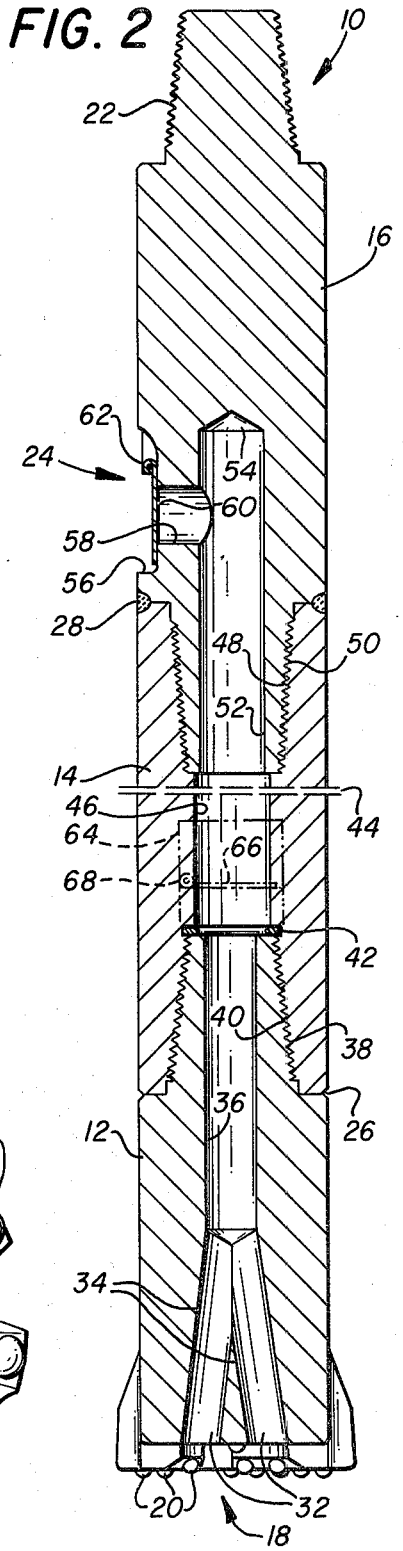
FIG. 2 is a cross-sectional view of the cable tool taken through line 2—2 in FIG. 1.

Referring now to FIG. 2, there is shown a cross-sectional view of cable tool 10 taken generally through the line 2—2 shown in FIG. 1. In this view, the transmission and storage of rock and earth particles within the cable tool 10 and the circulation of water or liquids through the cable tool 10 will be readily appreciated.

A pair of openings 32 are formed in the cutting face 18 for receiving rock and earth particles from the bottom of the well hole, and a pair of inclined bores 34 extend upwardly from the openings 32 and intersect within the tool bit 12. A bit passageway 36 extends upwardly from the intersection of the bores 34 to the upper end of the tool bit 12.

A threaded nipple 38 is formed on the upper end of tool bit 12, and a mating threaded receptacle 40 is formed in the lower end of the drill stem 14. The tool bit 12 is attached to the drill stem 14 by threadedly inserting the nipple 38 within the receptacle 40. A sealing gasket 42 is positioned adjacent the upper end of the nipple 38 to form a seal with the drill stem 14. As best illustrated in FIG. 1, the body of the tool bit 12 is provided with flattened side sections **12*a* and 12*b* to facilitate attaching the tool bit to the drill stem 14**.

A retention chamber 46 is formed within the drill stem 14 extending from and communicating with the bit passageway 36 to the upper end of the drill stem 14. As in FIG. 1, the drill stem 14 is shown in FIG. 2 with a substantial portion of its mid-region removed as indicated by break lines 44.

A threaded receptacle 48 is formed on the upper end of the drill stem 14, and a mating threaded nipple 50 is formed on the lower end of the adapter 16 and is threadedly attached within the receptacle 48. The adapter 16 and the drill stem 14 are then permanently joined by a junction weld 28 extending circumferentially around the cable tool 10 along the exterior junction between the adapter 16 and the drill stem 14. An adapter passageway 52 is formed within the adapter 16 communicating with and extending from the retention chamber 46 and terminating at a termination surface 54 within the adapter 16. The pressure relief drain 24 is formed in the adapter 16 communicating between the adapter passageway 52 and the exterior of the adapter 16.

The pressure relief drain 24 includes a recess 56, a drainbore 58, a door flap 60 and a pivot 62. The recess 56 is formed in the exterior of the adapter 16, and the drain bore 58 extends from the mid-region of the recess into the adapter 16 to communicate with the adapter passageway 52. The door flap 60 is mounted by the pivot 62 within the recess 56 and above the drain bore 58. The door flap 60 may pivot outwardly to allow liquid to drain from the cable tool 10, but will prevent foreign objects from the exterior of adapter 16 from entering into the drain bore 58. The recess 56 serves to space the door flap 60 away from the side walls of the well hole and thereby protect the door flap 60 during drilling operations.

As an option, a flapper valve 64, shown in phantom lines, may be mounted within the retention chamber 46 adjacent the passage 36. The flapper valve 64 includes a flapper 66 mounted on a pivot 68 which are also shown in phantom lines. The flapper 66 is moveable between a horizontal position and a generally upright position. The flapper 66 is moveable to a horizontal position for isolating the retention chamber 46 to block the transmission of rock and earth particles from the retention chamber 46 into the passageway 36. The flapper 66 is moveable to a generally upright position for allowing rock and earth particles to be transmitted from the passageway 36 into the retention chamber 46. The flapper 66 moves between the horizontal position and the generally upright position in response to the movement of rock, earth particles and liquid within the passageway 36 and the retention chamber 46. When the cable tool 10 is dropped, rock, earth particles and liquid travel upwardly in the passageway 36 forcing the flapper 66 to the upright, open position and entering the retention chamber 46. When the dropping motion of the cable tool 10 has ceased, and the cable tool 10 is again ready for lifting, the rock and earth particles within the retention chamber 46 will be pulled down by gravity to engage the flapper 66, forcing the flapper downwardly into the horizontal closed position.

In the repetitive dropping operation of the cable tool 10, the cutting face 18 repetitively impacts the bottom of the well hole. As rock and earth particles are cut, chiseled and crushed by the cutting face 18, the rock particles are forced by the downward thrust of the cable tool 10 to enter the openings 32 and travel upwardly through the inclined bores 34. As the dropping action continues, rock particles are forced up the passageway 36, through the flapper valve 64 and into the retention chamber 46.

Often, the cable tool 10 is working in a water environment, and in such case, water or other liquids will also travel up the inclined bores 34 and the passageway 36. The water then continues to travel up the retention chamber 46, into the adapter passageway 52 and out of the pressure relief drain 24. By the provision of relief 24, the water escapes the retention chamber 46 allowing additional rock and earth particles to be forced into and stored within the retention chamber 46. In normal operation, liquid or pressure will escape through the drain 24 during the downward thrust or drop of the cable tool 10. The circulation of water through the cable tool 10 as previously described also enhances the transmission of rock and earth particles through the cable tool 10. The water will act as a lubricant for the rock and earth particles and, also, the water rushing through the cable tool 10 will tend to urge rock and earth particles upwardly.

Figure 3:
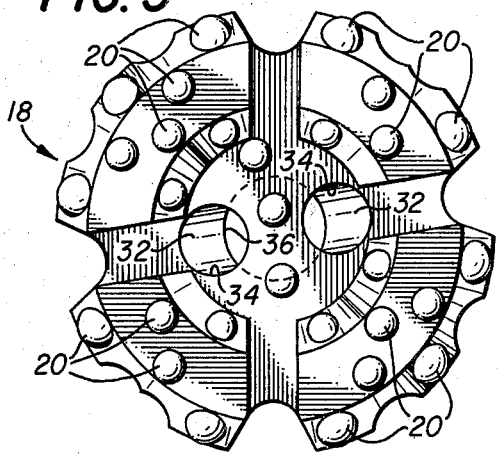
FIG. 3 is an end view of the cable tool showing a pair of openings in the cutting face of the tool bit.

Referring now to FIG. 3, there is shown an end view of the cutting face 18. A plurality of projections 20 are mounted on the cutting face 18 for cutting, chiseling and crushing rock and earth particles. The two openings 32 formed in the cutting face 18 for receiving rock and earth particles are circular, but it will be understood that the openings 32 may be any appropriate shape. Also, it will be understood that only one opening 32 is essential for the operation of the present invention, and that more than two openings 32 may also be provided.

Referring now to FIGS. 1, 2 and 3, the openings 32 are disposed in a recessed position near the center of the cutting face 18. In this position, the rock and earth particles in the bottom of the well hole which follow an almost directly upward route to enter into the openings 32 and travel up the inclined bores 34. It will be understood, however, that the openings 32 may be positioned further from or nearer to the center of the cutting face 18 without departing from the spirit of the invention.

After an extended drilling period, the inclined bores 34, the passageway 36, the retention chamber 46 and the adapter passageway 52 will be completely filled with rock and earth particles. With continued drilling by the dropping action, debris will accumulate in the bottom of the well hole, impairing the drilling efficiency of the cable tool 10. Eventually, the cable tool 10 must be removed from the well hole to remove the rock and earth particles from within the cable tool 10 and to clean out the debris from the well hole. However, if the cable tool 10 is promptly removed when it fills with rock and earth particles, it will not be necessary to clean out the well hole. Instead, the cable tool 10 may be immediately returned to the well hole to continue drilling operations.

The rock and earth particles may be removed from the cable tool 10 by any suitable method. In the embodiment shown in FIG. 2, the debris may be removed by removing the tool bit 12 from the drill stem 14 and cleaning the retention chamber 46. If the optional flapper valve 64 is used, it will be necessary to either open the flapper valve or remove it before the rock and earth particles may be removed from the lower end of the drill stem 14. Alternately, it is envisioned that water may be used to force the rock and earth particles upwardly through the drill stem 14 and out of the pressure relief drain 24. Also, water may be forced into the pressure relief drain 24 to urge the rock and earth particles out of the lower end of the retention chamber 46 with the flapper valve 64 either opened or removed.

Although the preferred embodiment has been described in the foregoing Detailed Description, it will be understood that the invention is capable of numerous rearrangements, modifications and substitutions of parts without departing from the scope and spirit of the present invention.

I claim:

1. In a cable tool for crushing and cutting rock and earth by a dropping action to form a well hole, the cable tool having a tool bit with a cutting face for dropping against rock and earth and having an upper tool body connected to the tool bit with an upper body end for connection to a cable for extending down the well hole, the improvement comprising:

at least one opening in the cutting face of the tool bit for receiving and removing rock and earth particles from the bottom of the well hole to facilitate the crushing and cutting of the rock and earth;

a passageway in the tool bit extending from said opening to the upper tool body for transmitting rock and earth particles upwardly away from the cutting face and the bottom of the well hole;

a retention chamber formed in the upper tool body for receiving rock and earth particles from said passageway to contain and store the rock and earth particles for subsequent removal when the cable tool is removed from the well hole; and pressure relief drain means formed through the side of the upper tool body from the exterior thereof to the retention chamber for draining liquid and releasing pressure from said retention chamber, whereby liquid, rock and earth particles are received through the opening, transmitted through said passageway, with rock and earth particles retained within the retention chamber and liquid passing through said chamber and out of said pressure relief drain means.

2. The cable tool of claim 1 further comprising a valve means in the retention chamber for transmitting liquid, rock and earth particles through said passageway to said retention chamber and for blocking the transmission of rock and earth particles from said retention chamber to said passageway.

3. The cable tool of claim 2 wherein said valve means comprises a flapper valve mounted in the lower portion of said retention chamber adjacent said passageway and having a flapper disposed for pivotal movement between a horizontal position for isolating said retention chamber from said passageway and a vertical position for transmitting liquid, rock and earth particles from said passageway to said retention chamber.

4. The cable tool of claim 1 wherein said pressure relief drain means comprises:

a recess formed in the exterior of the upper tool body;

a drain bore extending from the recess to the retention chamber; and a door flap pivotally attached to the upper tool body within said recess and above said drain bore for movement between a vertical position covering said bore and an inclined position for transmitting liquids from said bore to the exterior of the cable tool.

5. The cable tool of claim 1 wherein said opening comprises two inclined bores extending through the cutting face of the tool bit and intersecting at and communicating with said passageway in the tool bit.

6. In a cable tool for crushing and cutting rock and earth by a dropping action to form a well hole, the cable tool having a tool bit with a cutting face for dropping against the rock and earth, a drill stem attached to the upper end of the tool bit and an adapter attached to the upper end of the drill stem for attachment to a cable for extending through the well hole, the improvement comprising:

at least one opening in the cutting face of the tool bit for receiving rock and earth particles from the bottom of the well hole to facilitate the crushing and cutting of rock and earth;

a bit passageway in the tool bit extending from said opening to the drill stem for transmitting rock and earth particles upwardly and away from the cutting face and the bottom of the well hole;

a retention chamber formed in the drill stem for receiving rock and earth particles from said bit passageway to contain and store the rock and earth particles for subsequent removal when the cable tool is lifted from the well hole; and pressure relief drain means formed through the side of said adapter from the exterior thereof to the retention chamber for draining liquid and releasing pressure from said retention chamber, whereby liquid, rock and earth particles are received through said opening, transmitted through said bit passageway, with rock and earth particles retained within the retention chamber and liquid passing through said chamber and out of said pressure relief drain means.

7. The cable tool of claim 6 further comprising a valve means disposed in the retention chamber adjacent said bit passageway for blocking the transmission of rock and earth particles from said retention chamber to said bit passageway and for transmitting liquid, rock and earth particles from said bit passageway to said retention chamber.

8. The cable tool of claim 7 wherein said valve means comprises a flapper valve having a flapper pivotally mounted for rotation between a horizontal position to block the transmission of rock and earth particles from said retention chamber to said bit passageway and a generally upright position for transmitting rock and earth particles from said bit passageway to said retention chamber.

9. The cable tool of claim 6 wherein said opening comprises two inclined bores extending through the cutting face and communicating with said passageway in the tool bit.

10. A cable tool for crushing and cutting rock and earth by a dropping action to form a well hole, comprising:

a tool bit having a cutting face for dropping against rock and earth, said tool bit having at least one opening in the cutting face for receiving rock and earth particles from the bottom of the well hole to facilitate the crushing and cutting of rock and earth and having a bit passageway extending from said opening to the upper end of said tool bit for transmitting rock and earth particles upwardly;

a circulating drill stem attached to the upper end of said tool bit having a retention chamber formed within the drill stem for receiving rock and earth particles from said bit passageway to contain and store the rock and earth particles for subsequent removal when the cable tool is removed from the well hole;

an adapter attached to the upper end of the drill stem for attachment to a cable extending through the well hole; and pressure relief drain means formed through the side of said adapter from the exterior thereof to said retention chamber, whereby liquid, rock and earth particles are received through said opening, transmitted through said bit passageway, with rock and earth particles retained within the retention chamber and liquid passing through said chamber and out of said pressure relief drain means for relief of pressure and draining liquid from said retention chamber.

11. The cable tool of claim 10 further comprising a valve means disposed in the retention chamber adjacent said bit passageway for selectively blocking the transmission of rock and earth particles from said retention chamber to said bit passageway and for transmitting the rock and earth particles from said bit passageway to said retention chamber.

12. The cable tool of claim 11 wherein said valve means comprises a flapper valve having a flapper pivotally mounted for movement between a horizontal position for blocking the transmission of rock and earth particles from said retention chamber to said bit passageway and a generally upright position for transmitting rock and earth particles from said passageway to said retention chamber, said flapper valve being operable to move between the horizontal position and the upright position in response to the movement of rock and earth particles within said passageway and retention chamber.

13. In a cable tool for crushing and cutting rock and earth by a dropping action to form a well bore, the cable tool having a tool bit for attachment to a drill stem that includes a means for attachment to a cable, the drill stem having a retaining means, the improvement comprising:

a cutting face on the tool bit for dropping against rock and earth, said tool bit having at least one opening in the cutting face for receiving rock and earth particles from the bottom of the well hole to facilitate the crushing and cutting of rock and earth and having a bit passageway extending from said opening to the upper end of the tool bit for transmitting rock and earth particles upwardly;

a body section for the tool bit extending from the cutting face thereof and including an extension of the bit passageway from the cutting face;

retaining means formed as a part of said body section opposite from said cutting face, said retaining means mating with the retaining means of the drill stem for attachment of the tool bit to the drill stem; and pressure relief drain means formed through the side of said body section from the exterior thereof to said retaining means for draining liquid and releasing pressure from said retaining means, whereby liquid, rock and earth particles are received through said opening, transmitted through the bit passageway, with rock and earth particles retained within the retaining means and liquid passing through said retaining means and out of said pressure relief drain means.

14. The cable tool of claim 13 wherein said retaining means of the drill stem is an internally threaded section, and said retaining means formed as a part of said body section includes a threaded nipple.

15. The cable tool of claim 13 wherein said drill stem includes a retention chamber formed within the drill stem for receiving rock and earth particles from the bit passageway to contain and store the rock and earth particles for subsequent removal when the cable tool is removed from the well hole.

16. The cable tool of claim 15 further comprising valve means disposed in the retention chamber adjacent said bit passageway for selectively blocking the transmission of rock and earth particles from the retention chamber to said bit passageway and for transmitting rock and earth particles from said bit passageway to the retention chamber.

17. The cable tool of claim 16 wherein said valve means comprises a flapper valve having a flapper pivotally mounted for movement between a horizontal position for blocking the transmission of rock and earth particles from said retention chamber to the bit passageway and a generally upright position for transmitting rock and earth particles from the bit passageway to the retention chamber, said flapper valve being operable to move between the horizontal position and the upright position in response to the movement of rock and earth particles within the passageway and the retention chamber.

18. In a cable tool for crushing and cutting rock and earth by a dropping action to form a well hole, the cable tool having a tool bit with a cutting face for dropping against the rock and earth, a drill stem attached to the upper end of the tool bit and an adapter attached to the upper end of the drill stem for attachment to a cable for extending through the well hole, the improvement comprising:

at least one opening in the cutting face of the tool bit for receiving rock and earth particles from the bottom of the well hole to facilitate the crushing and cutting of rock and earth;

a bit passageway in the tool bit extending from said opening to the drill stem for transmitting rock and earth particles upwardly and away from the cutting face and the bottom of the well hole;

a retention chamber formed in the drill stem for receiving rock and earth particles from said bit passageway to contain and store the rock and earth particles for subsequent removal when the cable tool is lifted from the well hole;

a recess formed in the exterior of the adapter;

a drain bore extending from the recess inwardly into the adapter;

an adapter passageway communicating with said drain bore and extending to said retention chamber; and a door flap pivotally attached to said adapter within said recess and above said drain bore for selectively covering said drain bore and being operable to allow liquid to pass from said drain bore to the exterior of the adapter.

* * * * *